US006684761B2

(12) United States Patent
Yu Chen

(10) Patent No.: US 6,684,761 B2
(45) Date of Patent: Feb. 3, 2004

(54) STRAPPING PACKAGING DEVICE

(76) Inventor: Hsiu-Man Yu Chen, No. 27, Sec. 1, Dafu Rd., Tantz Shiang, Taichung 427 (TW)

( * ) Notice: Subject to any disclaimer, the term of this patent is extended or adjusted under 35 U.S.C. 154(b) by 0 days.

(21) Appl. No.: 10/166,072

(22) Filed: Jun. 11, 2002

(65) Prior Publication Data

US 2003/0226454 A1 Dec. 11, 2003

(51) Int. Cl.[7] ..... B65B 13/24; B65B 67/08

(52) U.S. Cl. ..... 100/29; 100/6; 53/592

(58) Field of Search ..... 100/29, 30, 32, 100/33 R, 33 PB, 6; 53/592, 590, 582; 140/93.2, 93 A; 156/494, 502, 579

(56) References Cited

U.S. PATENT DOCUMENTS 3,944,460 A * 3/1976 Karr ..... 156/494
4,240,865 A * 12/1980 Kyts ..... 156/494
5,058,365 A * 10/1991 Kagi ..... 53/582
6,412,257 B1 * 7/2002 Liu et al. ..... 53/592
6,516,715 B1 * 2/2003 Reiche ..... 100/29

* cited by examiner

*Primary Examiner*—Allen Ostrager
*Assistant Examiner*—Jimmy T Nguyen
(74) *Attorney, Agent, or Firm*—Troxell Law Office PLLC

(57) ABSTRACT

A strapping packaging device includes a compressing device, a cutting device, a strap-rolling device and a strap-pressing device. The eccentric cam of the compressing device is actuated to rotate by an operating rod, and the eccentric cam presses down a slide base together with a press block to compress on the strap-clamping member of a packaging strap. The strapping packaging device can not only precisely compress on the strap-clamping member, but also cut off the packaging strap easily at the same time.

8 Claims, 9 Drawing Sheets

STRAPPING PACKAGING DEVICE

BACKGROUND OF THE INVENTION

This invention relates to a strapping packaging device, particularly to one having functions of compressing a strap-clamping member precisely and cutting off a packaging strap easily at the same time.

A conventional manually operated strapping packaging device, as shown in FIG. 1, includes a strap-compressing device 2, a strap-rolling device 3 and a cutting device 4 combined together. In using, firstly a packaging strap 5 is tightly tied around an article to be packaged, and then both ends of the packaging strap are overlapped and fitted around with a strap-clamping member 6 to be tightly pressed together by means of a strapping sealer 7.

However, the conventional strapping packaging device 1 and the strapping sealer 7 have to be prepared and used independently, therefore a user has to carry on operating at two different locations with two different tools, inconvenient in using.

SUMMARY OF THE INVENTION

A main objective of the invention is to offer a strapping packaging device able to have its compressing device compressing a strap-clamping member, and its cutting device cutting off a packaging strap at the same time .

Another objective of the invention i s to offer a strapping packaging device having its eccentric cam actuated to force a lateral roller to rotate and actuate a slide base simply move up and down along a guide rod and let a press block directly compress the strap-clamping member with precision.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
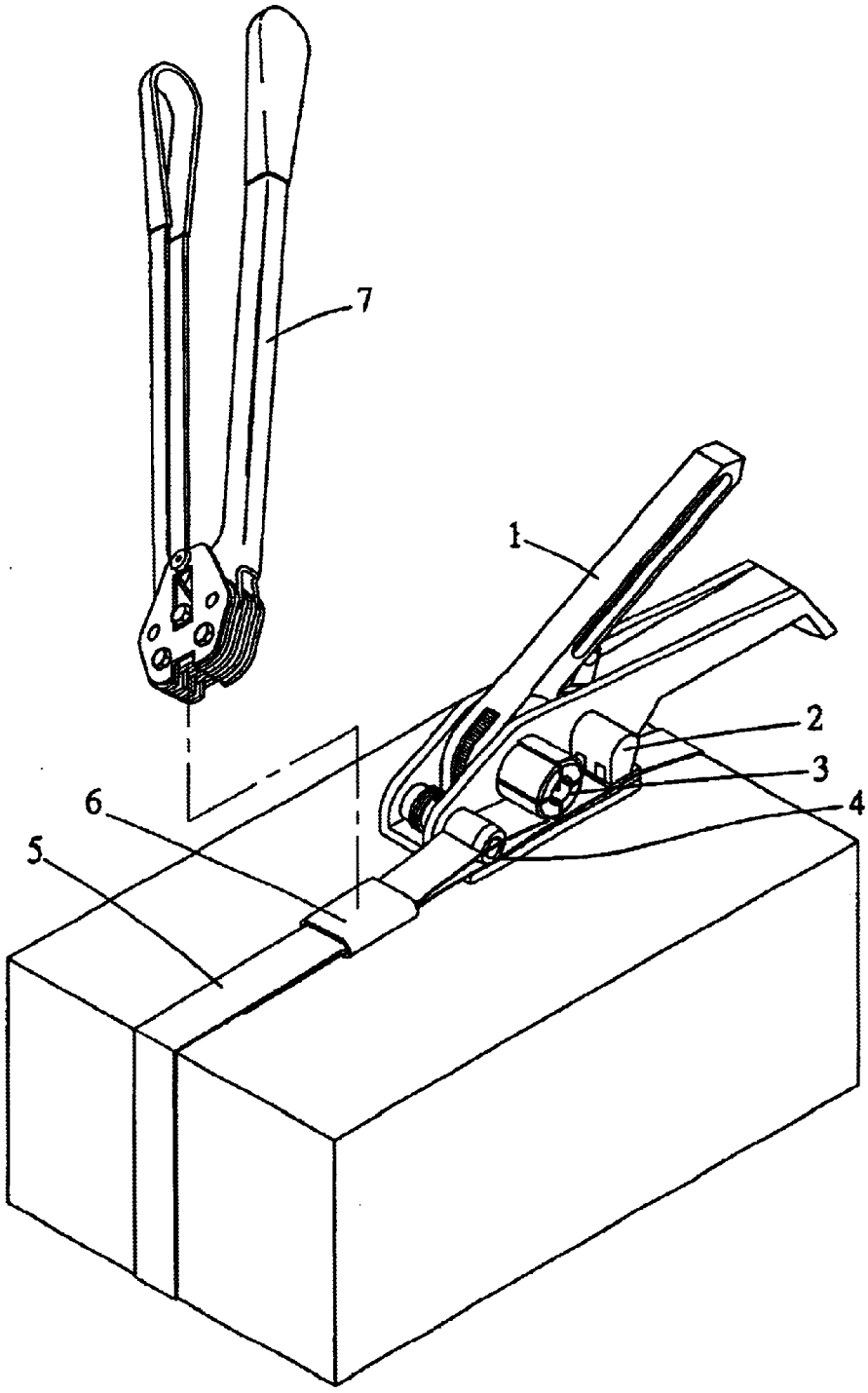
FIG. 1 PRIOR ART
FIG. 1 is a perspective view of a conventional strapping packaging device and a strapping sealer in a used condition.
Figure 2:
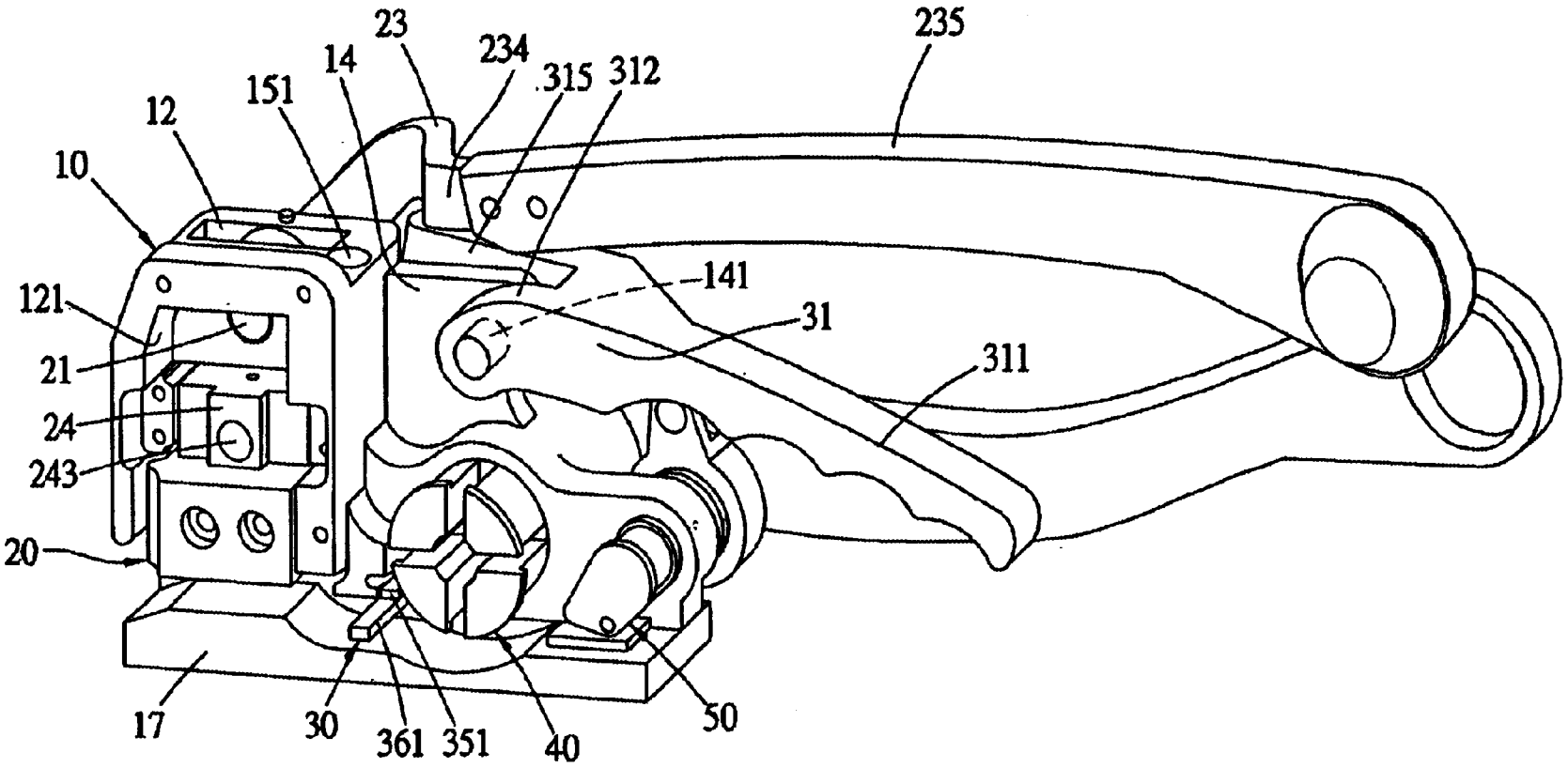
FIG. 2 is a perspective view of a strapping packaging device in the present invention.

A strapping packaging device in the present invention, as shown in FIG. 2, includes a body 10, a compressing device 20, a cutting device 30, s strap-rolling device 40 and a strap-pressing device 50 as main components combined together.

Figure 3:
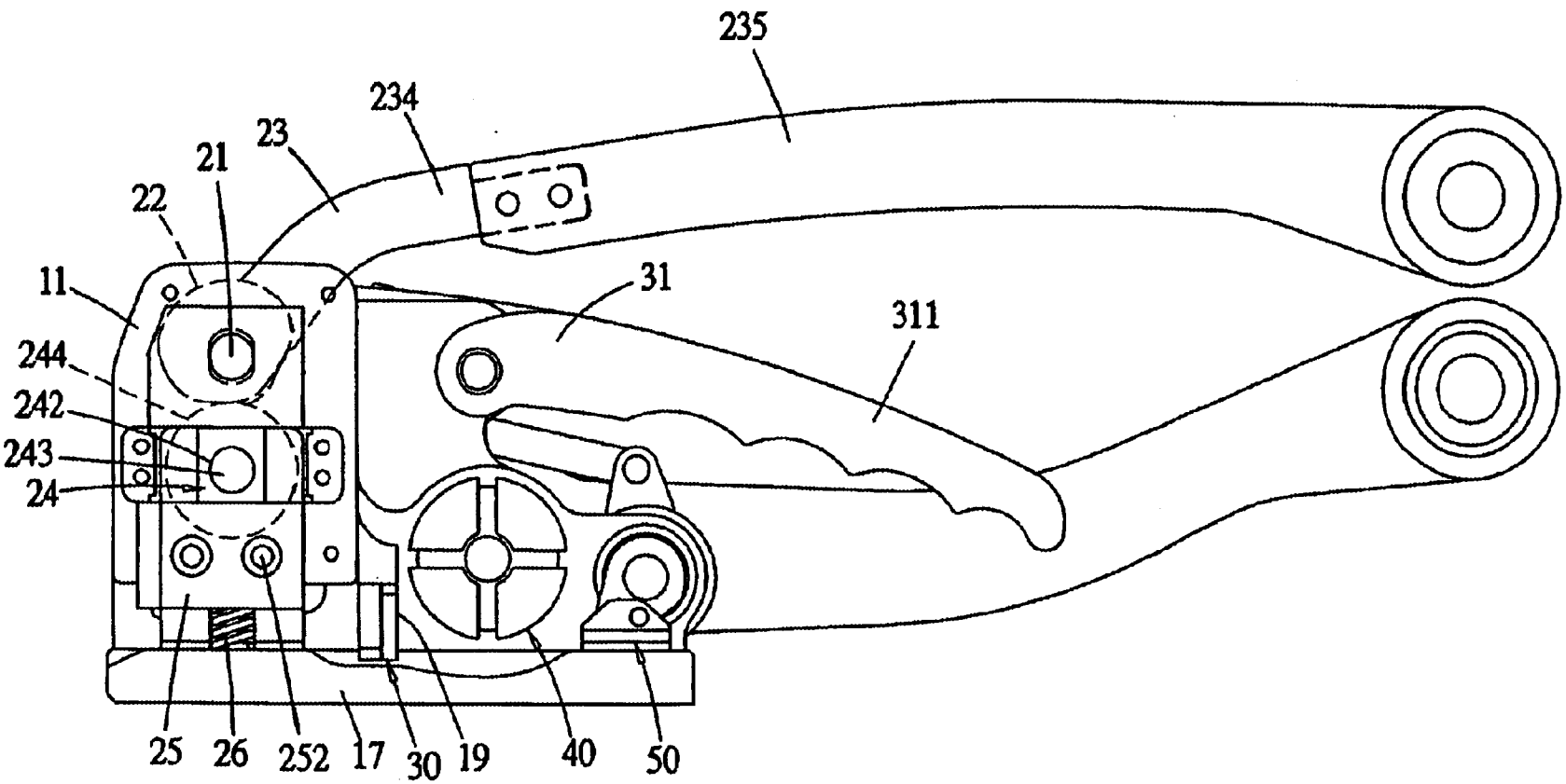
FIG. 3 is a side cross-sectional view of the strapping packaging device in the present invention.
Figure 4:
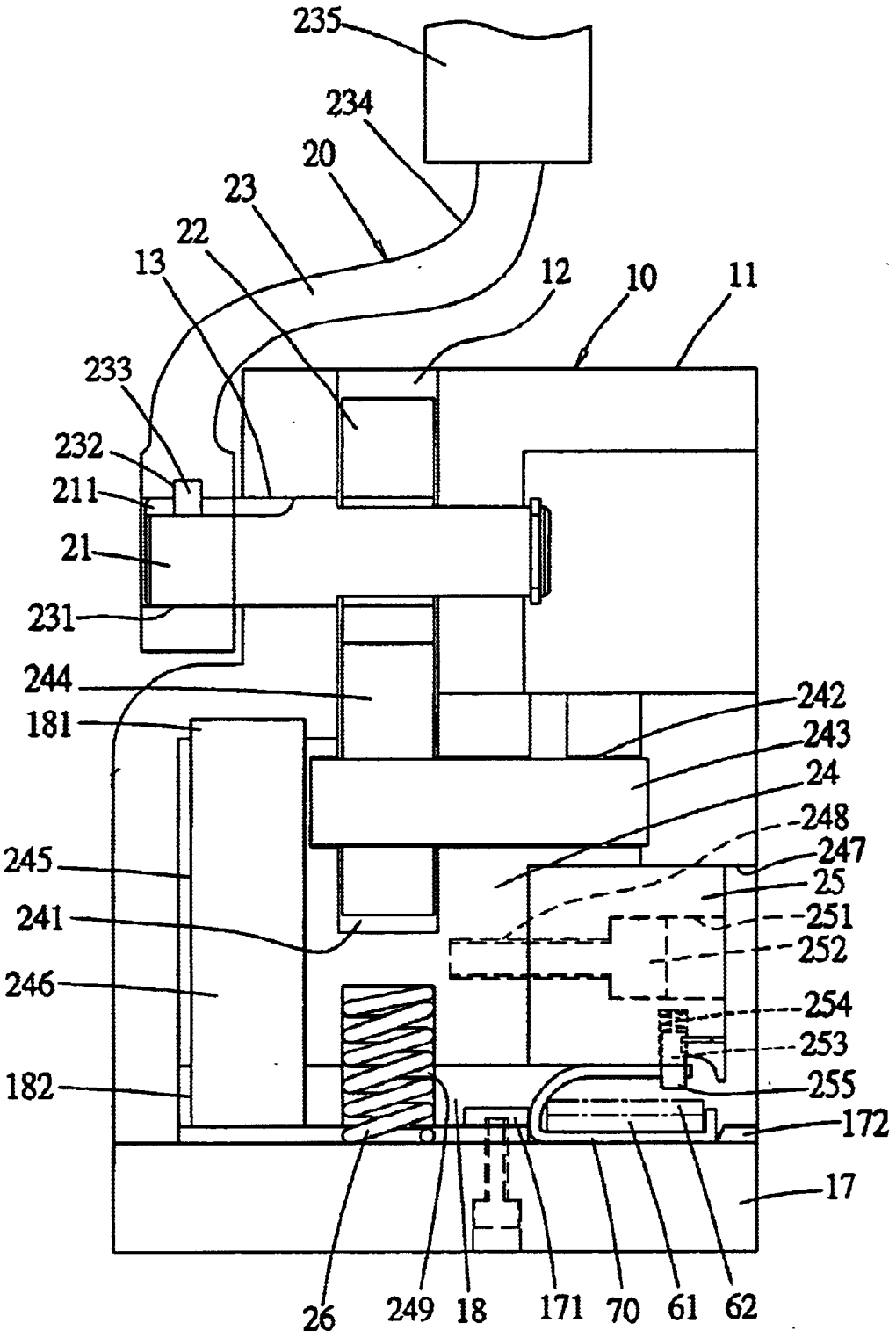
FIG. 4 is a cross-sectional view of a compressing device of the strapping packaging device in the present invention.
Figure 5:
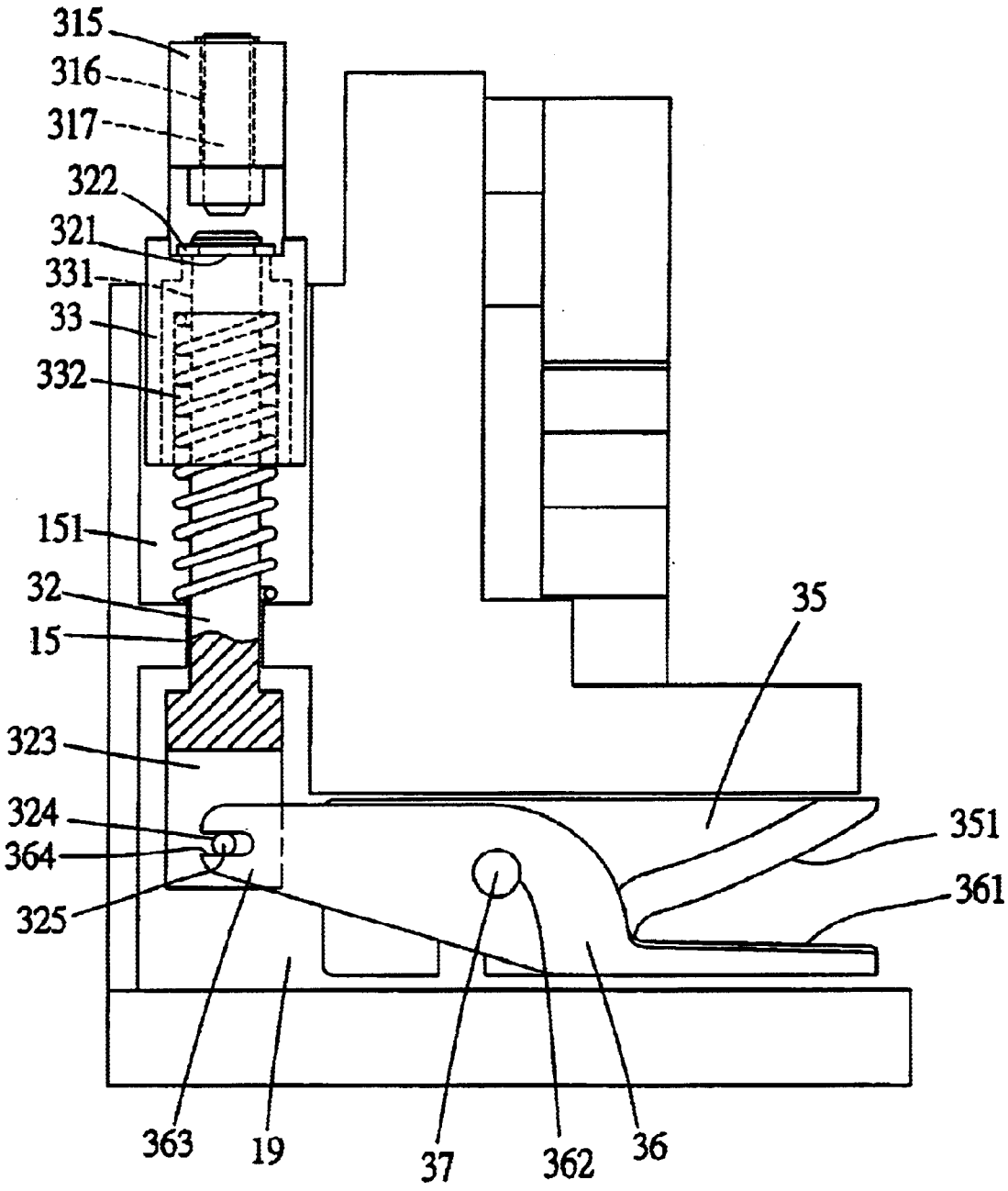
FIG. 5 is a cross-sectional view of a cutting device of the strapping packaging device in the present invention.

The body 10, as shown in FIGS. 3 and 4, is provided with a fixed base 11 at the front end. The fixed base 11 is provided with a hollow receiving space 12 in the center, a lateral shaft hole 13 at an intermediate portion, and a support block 14 protruding out backward on the outer side and having a lateral insert hole 141. Besides, as shown in FIG. 5, the fixed base 11 is formed at the rear side with a vertical through hole 15 having a first and a second receiving hole 151 and 152 respectively at an upper and a lower portion, with the diameter of the first and the second hole 151, 152 larger than that of the vertical hole 15. The body 10 is further provided with a bottom base 17, as shown in FIG. 4. Between the fixed base 11 and the bottom base 17 is a receiving space 18 having an upper and a lower position hole 181 and 182 provided symmetrically to face each other. Further, a blade base hole 19 is provided at a proper location of the outer side of the fixed base 11, horizontally extending inward from the outer side of the fixed base 11 to communicate with the vertical hole 15.

The compressing device 20, as shown in FIGS. 2, 3 and 4, consists of a transmitting shaft 21, an eccentric cam 22, an operating rod 23, a slide base 24, a press block 25 and a compression spring 26.

The transmitting shaft 21 has its inner end pivotally fitted in the lateral shaft hole 13 of the fixed base 11 and passing through the receiving space 12 and its outer end protruding out of the fixed base 11 and having a key groove 211.

The eccentric cam 22 is pivotally positioned at the center of the transmitting shaft 21 and received in the receiving space 12 of the fixed base 11.

The operating rod 23 is pivotally connected on the transmitting shaft 21 and positioned outside the fixed base 11. The operating rod 23 is bored at the front end with a fixing hole 231 having a key slot 232, with a fixing key 233 inserted in the key slot 232 of the operating rod 23 and the key hole 211 of the transmitting shaft 21. Further, the operating rod 23 has its intermediate portion bent into a curved section 234 and its end connected with a handle 235.

The slide base 24, as shown in FIG. 2, is received in the slide space 121 under the receiving space 12 of the fixed base 11 to slide up and down therein. As shown in FIG. 4, the slide base 24 is provided at the upper center with a vertical receiving hollow 241 having a lateral shaft hole 242 at a proper location of an intermediate portion for receiving a support rod 243. Then, a roller 244 is fixed around the support rod 243 in the receiving hollow 241 and positioned exactly under the eccentric cam 22 and contacting with the same cam 22. In addition, a vertical slide hole 245 is provided in the slide base 24 at one side of the receiving groove 241 of the slide base 24. The vertical slide hole 245 receiving a guide rod 246 having opposing ends inserted into the upper and lower positioning holes 181 and 182. The guide rod 246 guides and limits the slide base 24 to move axially up and down only. The slide base 24 is further bored with a notch 247 at a lower right side, two threaded holes 248 at proper positions in the inner wall and an insert hole 249 in the bottom.

The press block 25 for compressing a strap-clamping member 70 is bored with two locking holes 251 at the outer edge respectively for two locking bolts 252 to be inserted therein and lock the press block 25 fixedly at the notch 247 of the slide base 24. The press block 25 is further provided at the front bottom with an elastic pin 253 and a spring 254 on the elastic pin 253, which has an inward slanting press surface 255 at its lower end. Thus, the elastic pin 253 is actuated to rise up to let the strap-clamping member 70 get in the blade base hole 19, and then protrude downward, letting its press surface 255 hold the front edge of the strap-clamping member 70 after the strap-clamping member 70 moves in the blade base hole 19.

The compression spring 26 has one end positioned in the insert hole 249 of the slide base 24 and the other end resting against the topside of the bottom base 17.

Figure 6:
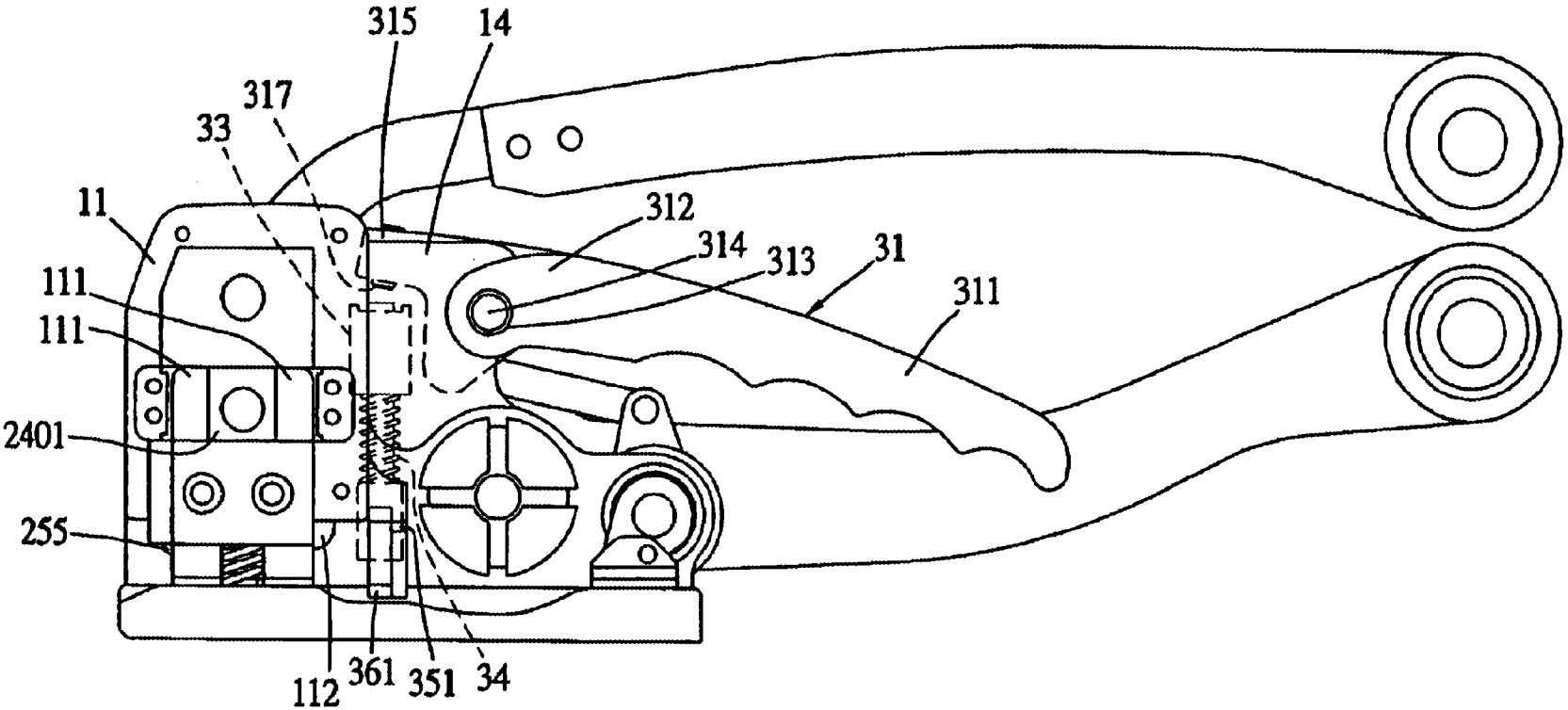
FIG. 6 is a side cross-sectional view of the cutting device assembled with other components in the present invention.

The cutting device 30, as shown in FIGS. 5 and 6, consists of a pull rod 31, a push rod 32, a sleeve 33, a spring 34, an upper blade 35, and a lower blade 36.

The pull rod 31 is formed with a handle 311 at the rear end and a connecting head 312 at the front end. The connecting head 312 is fitted astride the support block 14 of the fixed base 11 and provided with a pivotal hole 313 pivotally combined with a lateral insert hole 141 by means of a pivotal shaft 314. A press block 315 extends forward from the connecting head 312, and will be pushed downward when the pull rod 31 is turned around with the pivotal shaft 314 acting as a fulcrum. Additionally, the press block 315 is formed with a threaded hole 316 in the center for receiving an adjusting bolt 317 having its bottom end protrude out of the bottom of the press block 315.

The push rod 32 is fitted in the vertical hole 15 of the fixed base 11 and has its top end positioned exactly under the adjusting bolt 317 of the pull rod 31 in order to let the adjusting bolt 317 rest against the push rod 32. The push rod 32 is formed with an annular recess 321 on the top outer circumference for fitting a C-shaped clasp 322 therein, and a connecting fork 323 at the lower end in the second receiving hole 152 of the fixed base 11. The connecting fork 323 has a pinhole 324 horizontally passing through the connecting fork 323 for receiving a position pin 325 therein.

The sleeve 33 with a step-cylindrical shape fits around the upper end of the push rod 32, fitting in the first receiving hole 151 of the fixed base 11, and having a round through hole 331 in the center and a receiving space 332 in the interior of the lower end.

The spring 34 fits around the push rod 32, having its upper end extending into the receiving space 332 of the sleeve 33 and its lower end elastically pushing against the bottom side of the first receiving hole 151 of the fixed base 11.

The upper blade 35 is firmly fixed in the blade base hole 19, having a downward cutting edge 351 at the front end.

The lower blade 36 is coaxially and pivotally combined with the upper blade 35, having an upward cut edge 361 at the front end facing the cutting edge 351 of the upper blade 35. The lower blade 36 has a fixing hole 362 in the center and a connecting head 363 extending inward at the inner side to be inserted in the connecting fork 323 of the push rod 32. The connecting head 363 has a fit groove 364 in the rear end pivotally engaged with the position pin 325 of the connecting fork 323.

Moreover, the strap-rolling device 40 and the strap-pressing device 50 in the present invention respectively have the same structure as that of a conventional one, with their details omitted here.

Figure 7:
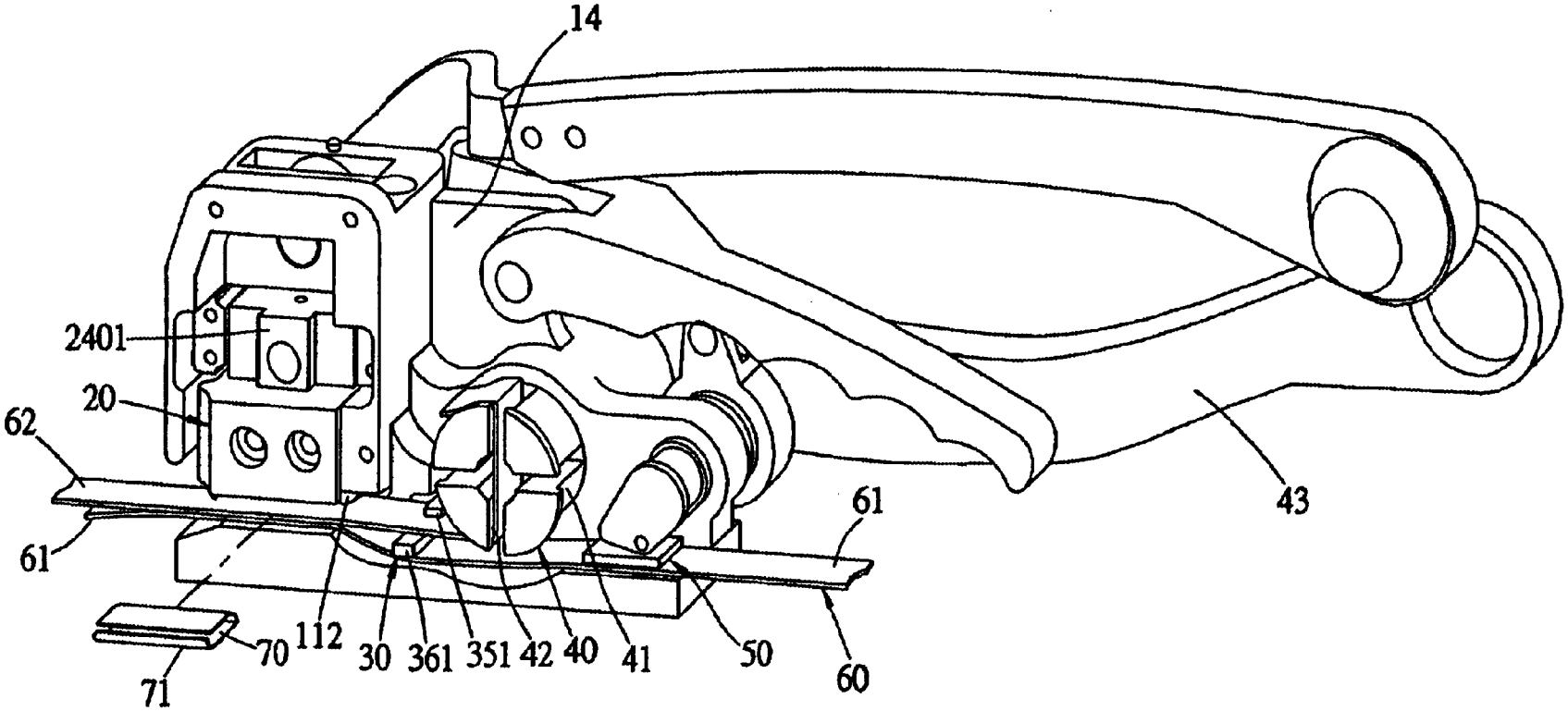
FIG. 7 is a side cross-sectional view of a packaging strap in an inserted condition in the present invention.

In assembling, as shown in FIGS. 4 and 5, firstly, the lateral roller 244 is pivotally fitted in the receiving hollow 241 of the slide base 24, and the support rod 243 is inserted into the shaft hole 242 to be assembled with the lateral roller 244. Then, the press block 25 is fixed in the notch 247 to be combined together with the slide base 24 by means of the locking bolt 252, and the compression spring 26 has its upper end sticking in the insert hole 249 of the slide base 24 and its lower end resting against the bottom base 17. At the same time, the guide rod 246 is deposited in the vertical slide hole 245 of the slide base 24 and has its opposite ends respectively lie in the position hole 181 and 182 of the fixed base 11 to let the guide rod 246 erected in the receiving space 18 between the fixed base 11 and the bottom base 17, and then the bottom base 17 is locked in position. In order to let the slide base 24 move comparatively smoothly, the opposite sides of an intermediate projecting portion 2401 at its outer side can be respectively fixed with two position members 111 to make the slide base 24 move up and down along the guide rod 246 in the receiving space 18, as shown in FIGS. 6 and 7.

Next, as shown in FIG. 4, the eccentric cam 22 together with the transmitting shaft 21 is pivotally positioned in the receiving space 12 of the fixed base 11, and the operating rod 23 is positioned outside the fixed base 11 and pivotally connected with the transmitting shaft 21 by the fixing key 233 inserted through the key hole 232 of the operating rod 23 and engaged with the key hole 211 of the transmitting shaft 21.

Subsequently, as shown in FIG. 5, the push rod 32 is fitted in the vertical hole 15 of the fixed base 11 and has its connecting fork 323 positioned in the second receiving hole 152 of the fixed base 11. Then, the spring 34 is fitted around the push rod 32 at the first receiving hole 151 and covered up by the sleeve 33, and a C-shaped clasp is locked in the annular recess 321 of the push rod 32, thus the push rod 32 restricted to move up and down in the vertical hole 15.

After that, the upper blade 35 and the lower blade 36 are coaxially and pivotally combined together by a fixing pin 37 and placed in the blade base hole 19 of the fixed base 11 , with their cutting edges 351 and 361 positioned at the outer side of the blade base hole 19 for facilitating cutting off a packaging strap. Then, the connecting head 363 of the lower blade 36 is inserted in the connecting fork 323 of the push rod 32 and has its connecting groove 364 at the end pivotally fitted with the position pin 325 of the push rod 32 to permit the lower blade 36 to move up and down together with the push rod 32 in cutting in cooperation with the upper blade 35.

Lastly, as shown in FIG. 6, the pull rod 31 has its connecting head 312 pivotally secured on the support block 14 of the fixed base 11 by means of the pivotal shaft 314, and the adjusting bolt 317 of the press block 315 is screwed in the threaded hole 316, enabling the adjusting bolt 317 to contact with and push against the top end of the push rod 32.

Figure 8:
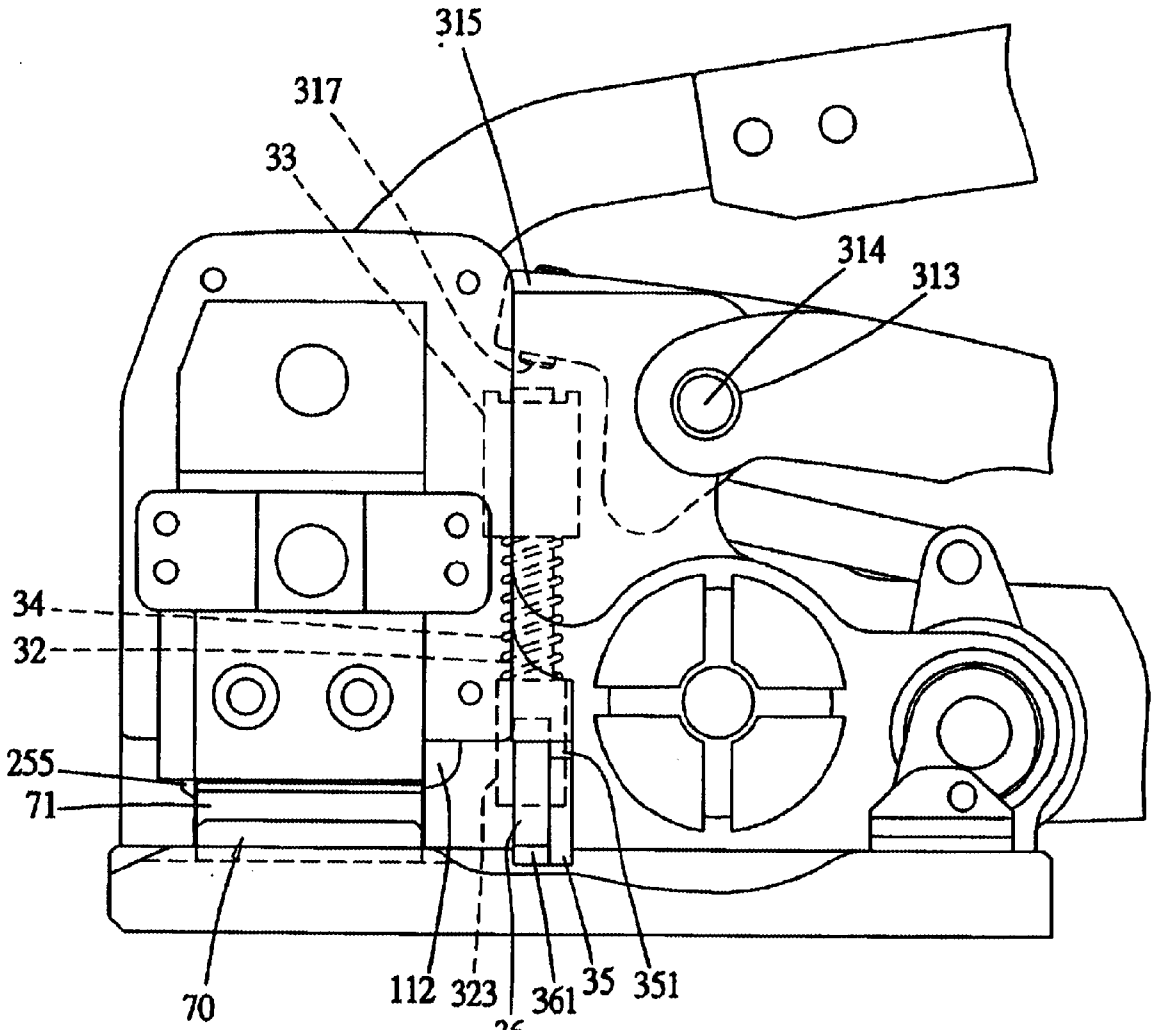
FIG. 8 is a side cross-sectional view of the cutting device cutting off a packaging strap in the present invention.

In using, as shown in FIGS. 4 and 8, the strap-clamping member 70 is first placed under the compressing device 20 through the front end of the compressing device 20, and the elastic pin 253 is actuated to protrude downward and has its press surface 255 holding the front edge of the strap-clamping member 70. Synchronously, the opposite sides of the strap-clamping member 70 are respectively stuck by the inner position block 171 and the outer position block 172 of the bottom base 17, and the rear side held by the stopping member 112 protruding downward under the fixed base 11, as shown in FIGS. 6 and 7.

Then, as shown in FIG. 7, the fixed end 61 of a packaging strap 60 is inserted from back to front through the strap-pressing device 50, the strap-rolling device 40, the cutting device 30 and an intermediate through hole 71 of the strap-clamping member 70 under the compressing device 20 to be pressed securely by the strap-pressing device 50. While the free end 62 of the packaging strap 60 is inserted from front to back through the intermediate through hole 71 of the strap-clamping member 70 to overlap on the fixed end 61 and continue to pass through between the upper blade 35 and the lower blade 36 of the cutting device 30, wound around the outer edge of the strap-rolling wheel 41 of the strap-rolling device 40 and having its end inserted in the seam 42 of the strap-rolling wheel 41 and secured therein. Then, pull the handle 43 of the strap-rolling device 40 to rotate the strap-rolling wheel 41 to tighten the free end 62 of the packaging strap 60 and binding a box tightly.

Figure 9:
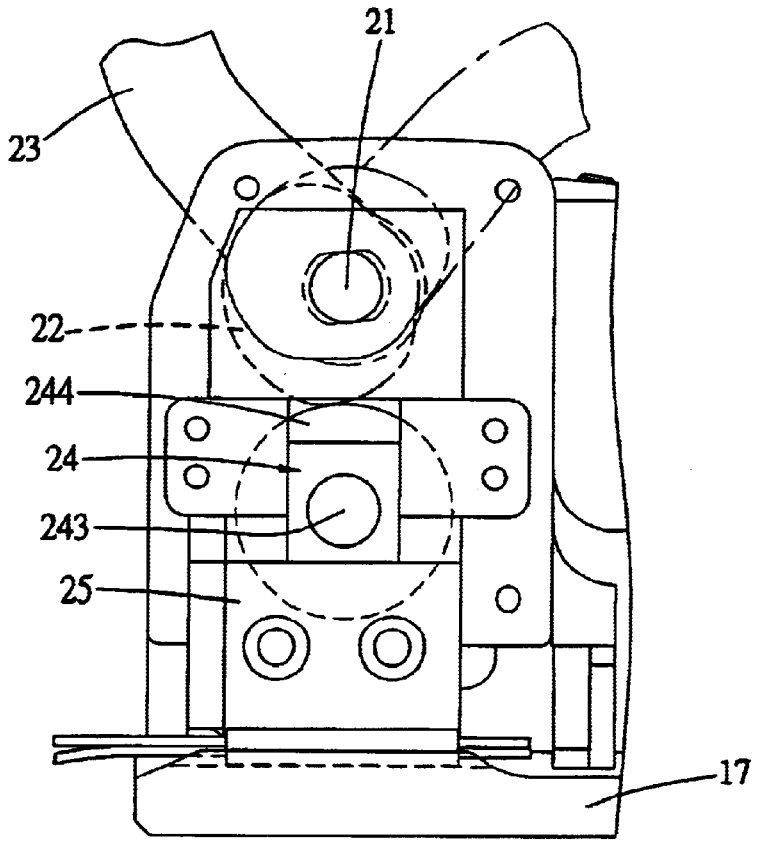
FIG. 9 is a side cross-sectional view of a compressing device having its press block compress the strap-clamping member in the present invention.
Figure 10:
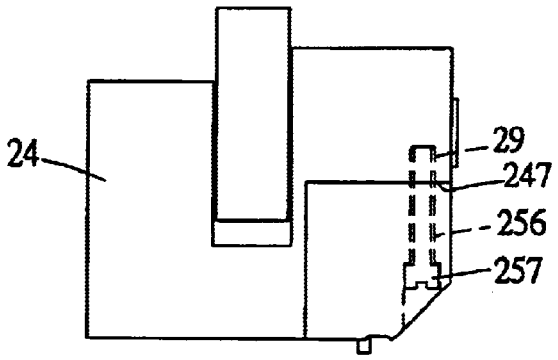
FIG. 10 is a cross-sectional view of another embodiment of the press block in the present invention.

Next, as shown in FIG. 9, press down the operating rod 23 of the compressing device 20, letting the eccentric cam 22 press the lateral roller 244 to move downward together with the slide base 24 and the pressing block 25, which presses the strap-clamping member 70 deformed so as to make the overlapped portion of the fixed and the free ends 61 and 62 of the packaging strap 60 tightened and engaged with each other.

Lastly, as shown in FIG. 5, pull up the pull rod 31, letting the adjusting bolt 317 of the press block 315 force the push rod 32 move down together with its connecting fork 323, which will actuate the connecting head 363 of the lower blade 36 move down, and with the fixing pin 37 acting as a fulcrum, the cutting edge 361 of the lower blade 36 will move up to cut off the packaging strap 60 in cooperation with help of the cutting edge 351 of the upper blade 35.

Furthermore, threaded hole 29 can also be provided at the bottom of the notch 247 of the slide base 24, and locking holes 256 preset in number are bored at the bottom edge of the press block 25, with a locking bolt 257 inserted from the bottom through the locking hole 257 and the threaded hole 29 to lock the press block 25 and the slide base 24 together.

As can be noted from the above description, this invention has the following advantages.

1. The strapping packaging device can not only press the strap-clamping member 70 by the compressing device 20, but also cut off the packaging strap by the cutting device 30 at the same time, easy and convenient in use.

2. The eccentric cam 22 is actuated to press the lateral roller 244 to force the slide base 24 simply move up and down along the guide rod 246, so that the press block 25 can directly compress the strap-clamping member 70 precisely and smoothly.

While the preferred embodiment of the invention has been described above, it will be recognized and understood that various modification s may be made therein and the appended claims are intended to cover all such modifications that may fall within the spirit and scope of the invention.

I claim:

1. A strapping packaging device comprising: a body, a compressing device, a cutting device, a strap-rolling device and a strap-pressing device;

said body provided with a bottom base and a fixed base at the front side, said fixed base having a receiving space in an intermediate portion, the receiving space having an upper positioning hole and a lower positioning hole; and said compressing device comprising:

a transmitting shaft pivotally fitted in said fixed base and passing through said receiving space of said fixed base, and having its outer end extending out of said fixed base;

an eccentric cam pivotally fitted at the center of said transmitting shaft, and located in said receiving space of said fixed base;

an operating rod positioned outside said fixed base, pivotally combined with said transmitting shaft, and driving said transmitting shaft and said eccentric cam to rotate;

a slide base received in a slide space under said receiving space to move up and down therein, said slide base provided with a roller at the upper end, said roller located exactly under said eccentric cam, said roller and said eccentric cam able to contact with each other, said slide base having a notch at a lower portion of one side;

a press block firmly fixed at said notch of said slide base, said press block pressing on a strap-clamping member; and a compression spring having one end positioned in the insert hole of said slide base and the other end resting against said bottom base of said body, wherein said press block is provided with an elastic pin at a front bottom, said elastic pin having a spring inside and an inward slanting press surface at bottom end, said elastic pin rising up to let the strap-clamping member get in, said elastic pin protruding down again and having its press surface hold the front edge of said strap-clamping member in position when said strap-clamping member passes, said strap-clamping member having opposite sides stuck respectively by an inner and an outer position block of said bottom base, said strap-clamping member having its rear side held by a stop block protruding downward at the bottom of said fixed base.

2. The strapping packaging device as claimed in claim 1, wherein said slide base is provided with a vertical receiving hollow at an upper center, a lateral shaft hole formed at a proper position of said receiving hollow for fitting a support rod, said roller fitted around said support rod in said receiving hollow.

3. The strapping packaging device as claimed in claim 2, wherein said slide base is provided with a vertical slide hole at one side of a receiving hole, said vertical slide hole receiving inside a guide rod, said guide rod having opposing ends inserted into the upper and lower positioning holes of the fixed base, said guide rod guiding and limiting said slide base to move up and down.

4. A strapping packaging device comprising: a body, a compressing device, a cutting device, a strap-rolling device and a strap-pressing device;

said body provided with a bottom base and a fixed base at the front side, said fixed base having a receiving space in an intermediate portion, the receiving space having an upper positioning hole and a lower positioning hole; and said compressing device comprising:

a transmitting shaft pivotally fitted in said fixed base and passing through said receiving space of said fixed base, and having its outer end extending out of said fixed base;

an eccentric cam pivotally fitted at the center of said transmitting shaft, and located in said receiving space of said fixed base;

an operating rod positioned outside said fixed base, pivotally combined with said transmitting shaft, and driving said transmitting shaft and said eccentric cam to rotate;

a slide base received in a slide space under said receiving space to move up and down therein, said slide base provided with a roller at the upper end, said roller located exactly under said eccentric cam, said roller and said eccentric cam able to contact with each other, said slide base having a notch at a lower portion of one side;

a press block firmly fixed at said notch of said slide base, said press block pressing on a strap-clamping member; and a compression spring having one end positioned in the insert hole of said slide base and the other end resting against said bottom base of said body, wherein said press block is bored with two locking holes at preset locations, locking bolts of a preset number respectively inserted through said locking holes to fix said press block at said notch of said slide base.

5. A strapping packaging device comprising: a body, a compressing device, a cutting device, a strap-rolling device and a strap-pressing device;

said body provided with a bottom base and a fixed base at the front side, said fixed base having a receiving space in an intermediate portion, the receiving space having an upper positioning hole and a lower positioning hole; and said compressing device comprising:

a transmitting shaft pivotally fitted in said fixed base and passing through said receiving space of said fixed base, and having its outer end extending out of said fixed base;

an eccentric cam pivotally fitted at the center of said transmitting shaft, and located in said receiving space of said fixed base;

an operating rod positioned outside said fixed base, pivotally combined with said transmitting shaft, and driving said transmitting shaft and said eccentric cam to rotate;

a slide base received in a slide space under said receiving space to move up and down therein, said slide base provided with a roller at the upper end, said roller located exactly under said eccentric cam, said roller and said eccentric cam able to contact with each other, said slide base having a notch at a lower portion of one side;

a press block firmly fixed at said notch of said slide base, said press block pressing on a strap-clamping member; and a compression spring having one end positioned in the insert hole of said slide base and the other end resting against said bottom base of said body, wherein said slide base is formed with a projecting portion at the center of outer side, said projecting portion having opposite sides respectively fixed with a position member to restrict said slide base to move in a preset position.

6. A strapping packaging device comprising: a body, a compressing device, a cutting device, a strap-rolling device and a strap-pressing device;

said body provided with a bottom base and a fixed base at the front side, said fixed base having a receiving space in an intermediate portion, the receiving space having an upper positioning hole and a lower positioning hole; and said compressing device comprising:

a transmitting shaft pivotally fitted in said fixed base and passing through said receiving space of said fixed base, and having its outer end extending out of said fixed base;

an eccentric cam pivotally fitted at the center of said transmitting shaft, and located in said receiving space of said fixed base;

an operating rod positioned outside said fixed base, pivotally combined with said transmitting shaft, and driving said transmitting shaft and said eccentric cam to rotate;

a slide base received in a slide space under said receiving space to move up and down therein, said slide base provided with a roller at the upper end, said roller located exactly under said eccentric cam, said roller and said eccentric cam able to contact with each other, said slide base having a notch at a lower portion of one side;

a press block firmly fixed at said notch of said slide base, said press block pressing on a strap-clamping member; and a compression spring having one end positioned in the insert hole of said slide base and the other end resting against said bottom base of said body, said cutting device comprising:

a pull rod provided with a connecting head at the front end to press down the press block of said compressing device;

a push rod fitted in said vertical hole of said fixed base, and provided with a pin hole for receiving a position pin; and an upper and a lower blade coaxially and pivotally combined together, said upper and said lower blade positioned in a blade base hole at a proper location of an outer side of said fixed base, said upper blade being fixed and having a downward cutting edge, said lower blade formed inward with a connecting head extending into the interior of said blade base hole, said connecting head of said lower blade fitted with said position pin of said push rod, said lower blade having an upward cutting edge;

said push block of said pull rod actuated to push down said push rod, said push rod, with said position pin acting as a fulcrum, actuating said lower blade move up and cut off a packaging strap in cooperation with said upper blade when said pull rod is pulled up.

7. A strapping packaging device comprising: a body, a compressing device, a cutting device, a strap-rolling device and a strap-pressing device;

said body provided with a bottom base and a fixed base at the front side, said fixed base having a receiving space in an intermediate portion, the receiving space having an upper positioning hole and a lower positioning hole; and said compressing device comprising:

a transmitting shaft pivotally fitted in said fixed base and passing through said receiving space of said fixed base, and having its outer end extending out of said fixed base;

an eccentric cam pivotally fitted at the center of said transmitting shaft, and located in said receiving space of said fixed base;

an operating rod positioned outside said fixed base, pivotally combined with said transmitting shaft, and driving said transmitting shaft and said eccentric cam to rotate;

a slide base received in a slide space under said receiving space to move up and down therein, said slide base provided with a roller at the upper end, said roller located exactly under said eccentric cam, said roller and said eccentric cam able to contact with each other, said slide base having a notch at a lower portion of one side;

a press block firmly fixed at said notch of said slide base, said press block pressing on a strap-clamping member; and a compression spring having one end positioned in the insert hole of said slide base and the other end resting against said bottom base of said body, wherein a pull rod is provided with a connecting head at a front end, said connecting head pivotally connected with a support block outside said fixed base, said connecting head formed with a push block extending forward, said push block provided with a threaded hole in the center for an adjusting bolt screwed therein, said adjusting bolt having its bottom end protruding out of the bottom of said push block.

8. The strapping packaging device as claimed in claim 7, further comprising a push rod fitted in a vertical hole of said fixed base, said push rod is formed with an annular recess at the top outer circumference, said annular recess fitted in with a C-shaped clasp, said push rod provided with a connecting fork at the lower end for fitting a position pin, a sleeve with a step-cylindrical shape fitted around an upper end of said push rod, said sleeve formed with a round through hole in the center and a receiving space in the interior of the lower side for receiving a spring.

* * * * *